United States Patent [19]

Stratton

[11] Patent Number: 4,577,354

[45] Date of Patent: Mar. 25, 1986

[54] PORTABLE BATHING APPARATUS

[75] Inventor: David M. Stratton, Marquette Heights, Ill.

[73] Assignee: Morton Metalcraft Company, Morton, Ill.

[21] Appl. No.: 639,572

[22] Filed: Aug. 10, 1984

[51] Int. Cl.[4] ..... A47K 3/06

[52] U.S. Cl. ..... 4/585

[58] Field of Search ..... 4/585–587

[56] References Cited

U.S. PATENT DOCUMENTS 2,253,995 8/1941 Baxter et al. ..... 4/587 X
2,860,349 11/1958 Blomqvist ..... 4/540
3,800,336 4/1974 Hoxeng ..... 4/587

FOREIGN PATENT DOCUMENTS 155303 11/1903 Fed. Rep. of Germany ..... 4/585

*Primary Examiner*—Charles E. Phillips
*Attorney, Agent, or Firm*—Allegretti, Newitt, Witcoff & McAndrews, Ltd.

[57] ABSTRACT

An improved portable bathing apparatus is comprised of a generally planar platform mounted on a movable cart with a flexible tub enclosure supported on the platform by a framework that may be raised and lowered. An arrangement of articulated arms driven by a mechanical linkage operates to move the framework between the tub formed and a tub collapsed position. The linkage includes a special locking mechanism to insure that the framework will maintain the formed tub enclosure.

11 Claims, 12 Drawing Figures

PORTABLE BATHING APPARATUS

BACKGROUND OF THE INVENTION

This invention relates to an improved portable bathing apparatus of the type which comprises a portable hospital patient cart with a flexible tub enclosure that may be formed on the cart. More particularly, the subject matter of the present invention relates to the specific framework and linkage mechanism which is utilized to form the tub enclosure and maintain the tub enclosure on the cart.

Heretofore, it has been known to provide a portable hospital cart having a flexible tub enclosure formed and supported by a framework on the carrying platform of a cart to provide a tub enclosure for bathing or otherwise treating a patient. For example, U.S. Pat. No. 2,860,349 discloses such a tub enclosure cart. The subject matter of U.S. Pat. No. 2,860,349 is incorporated herewith by reference. A commercial version of the product depicted in U.S. Pat. No. 2,860,349 has been sold by the assignee of this application under the tradename Aide-a-Bath.

Typically, such a prior art cart includes a generally horizontal platform supported on legs having wheels. A flexible, waterproof enclosure defining a tub enclosure is positioned on the platform and supported by a framework which may be raised and lowered to define or remove the sides of the tub enclosure. In this manner, the tub may be formed once a patient is placed on the platform by raising the sides of the tub enclosure. Bathing water may then be placed inside the tub enclosure for bathing the patient.

While the prior art tub enclosure cart has been useful and works well to perform its intended function, the linkage mechanism associated with the raising and lowering of the sides of the tub enclosure required improvement. In particular, the linkage should desirably uniformly raise the framework supporting the tub enclosure vertically upward from the horizontal platform of the cart. Additionally the linkage supporting the framework should operate easily and should also include a means for locking the tub enclosure in its formed position to insure the framework will not collapse or give way when the enclosure is filled with water. These considerations and others led to the development of the invention described hereinafter.

SUMMARY OF THE INVENTION

Briefly, the present invention comprises a portable bathing apparatus of the type having a support platform mounted on legs and rendered portable by wheels attached to those legs. A tub enclosure made of a flexible material supported by a movable framework is positioned on top of the platform. The framework is driven by a special linkage between an open and closed position to form or collapse a tub enclosure on the top of the platform. The special linkage includes means for locking the tub enclosure framework.

The linkage includes articulated arms which support the framework for the tub enclosure. The articulated arms are operated in response to movable connecting links that drive the articulated arms positively toward the open or formed tub position as well as the retracted or collapsed tub position. A locking mechanism associated with the links ensures that the formed tub enclosure will maintain its formed condition.

Thus, it is an object of the present invention to provide an improved portable bathing apparatus.

It is a further object of the invention to provide an improved portable bathing apparatus which includes a transportable cart having a horizontal platform with a flexible tub enclosure positioned on top of the platform that may be formed into a tub enclosure.

A further object of the invention is to provide an improved linkage supporting a framework for a collapsible tub enclosure.

Still another object of the invention is to provide an improved linkage which may be locked to maintain the tub enclosure in a formed condition.

Another object of the invention is to provide an improved portable tub enclosure which is easy to operate, and is economical to manufacture.

These and other objects, advantages, and features of the invention will be set forth in the detailed description which follows.

BRIEF DESCRIPTION OF THE DRAWING

In the detailed description which follows, reference is made to the drawing comprised of the following figures.

Figure 7A:
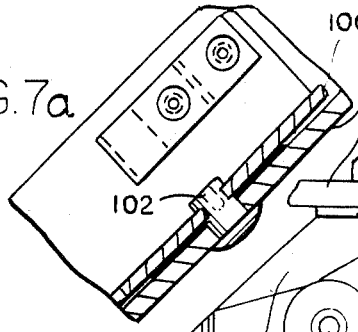
FIG. 7 is an enlarged plan view of the control linkage for the framework when the framework is in the lowered position.
Figure 7:
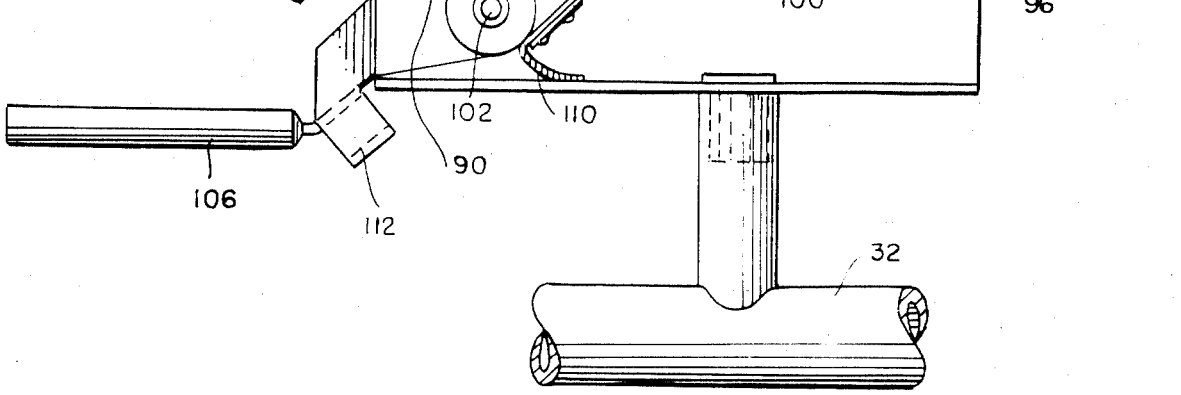
Figure 8:
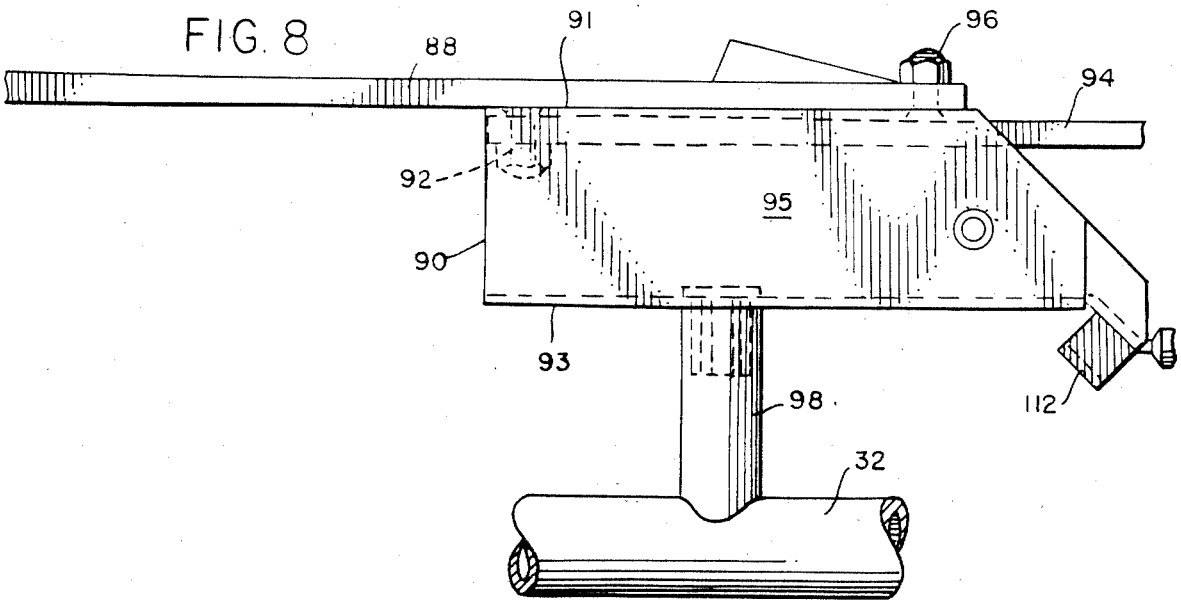
Figure 9:
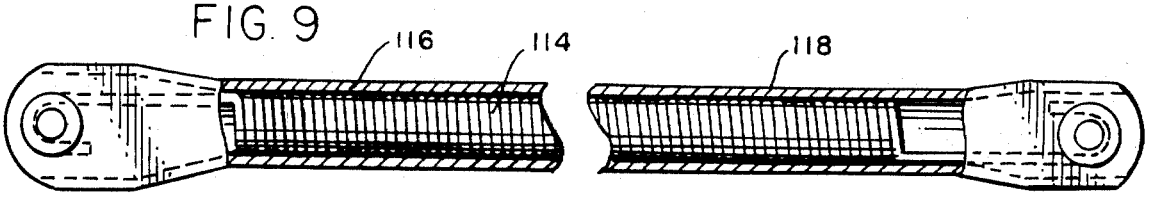
Figures 10, 11:
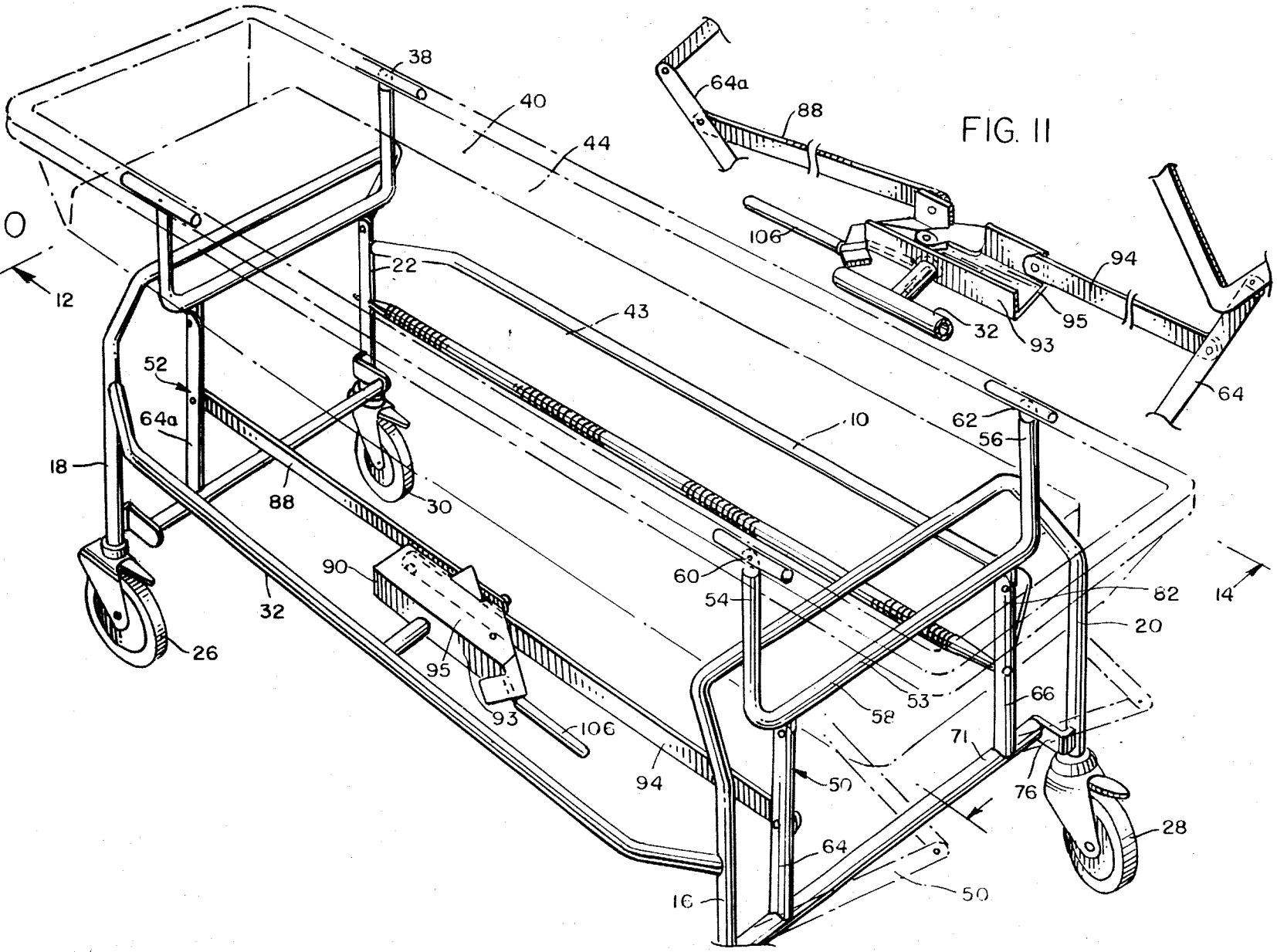

FIG. *7a* is a detailed sectional view illustrating the pivotal connection between the linkage plate and the locking plate;

FIG. 8 is a plan view similar to FIG. 7 wherein the control linkage is positioned to raise the tub enclosure;

FIG. 9 is a side cross-sectional view of the part of the linkage which assists in maintaining the tub enclosure in its formed condition;

FIG. 10 is a perspective view of the cart in the tub formed position; and

FIG. 11 is a partial perspective view of the locking linkage in the tub lowered position.

DESCRIPTION OF THE PREFERRED EMBODIMENT

Referring to the figures, the improved portable bathing apparatus of the invention comprises a cart having a generally horizontal bed tray or platform 10 having a longitudinal dimension 12 and a lateral dimension 14. The tray or platform 10 may be generally horizontal or may be formed in the shape of a trough. Platform 10 is designed to support a patient who is being transported by means of the cart.

The tray or platform 10 is supported by legs 16, 18, 20, 22 attached generally adjacent to four corners of the tray or platform 10. The legs depend vertically from the platform 10 and preferably have wheels 24, 26, 28, 30, respectively, for support of the platform 10 and for ease of transport of the cart 10. A support bracket 32 connects legs 16 and 18. In a similar fashion, a support bracket 34 connects legs 20 and 22.

Figure 1:
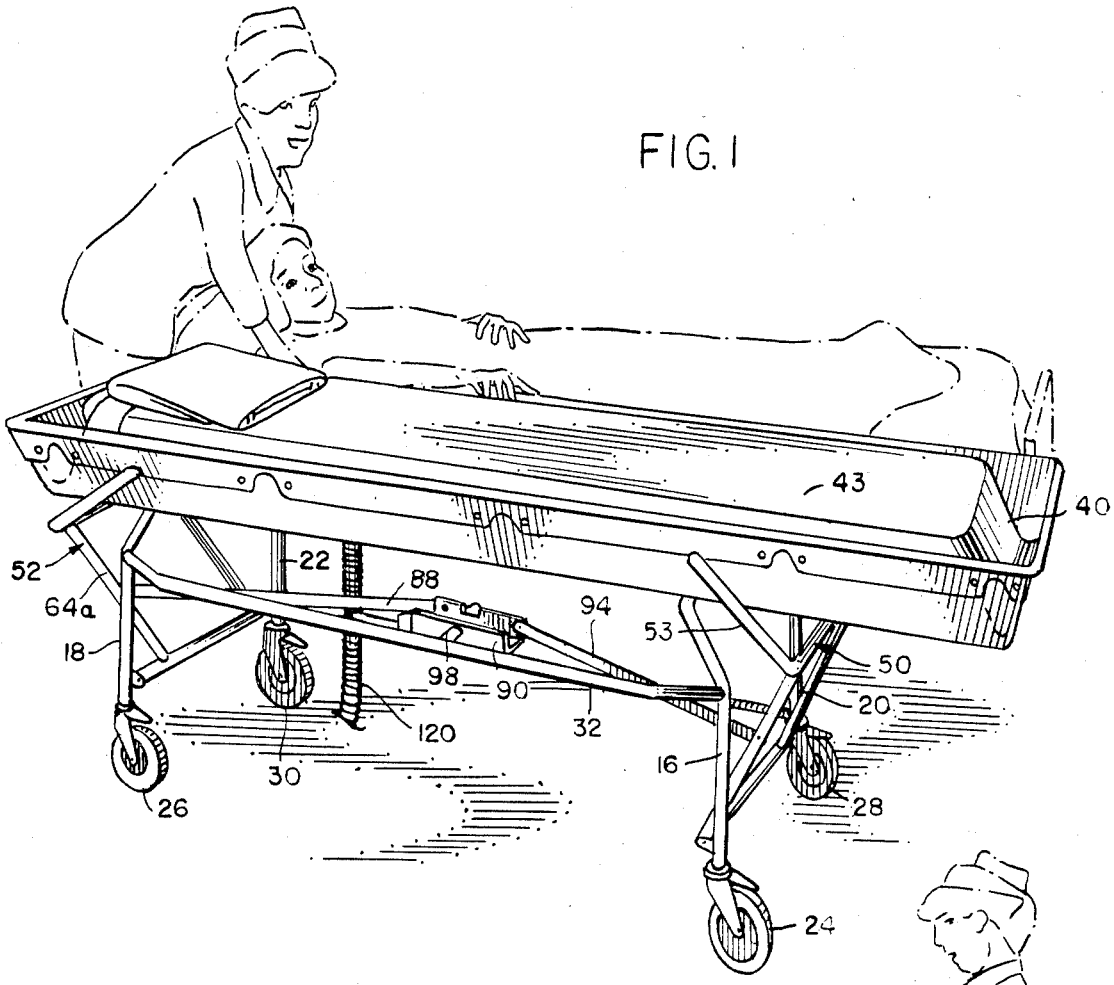
FIG. 1 is a perspective view of the improved apparatus of the invention with the flexible tub enclosure in the lowered position.
Figure 2:
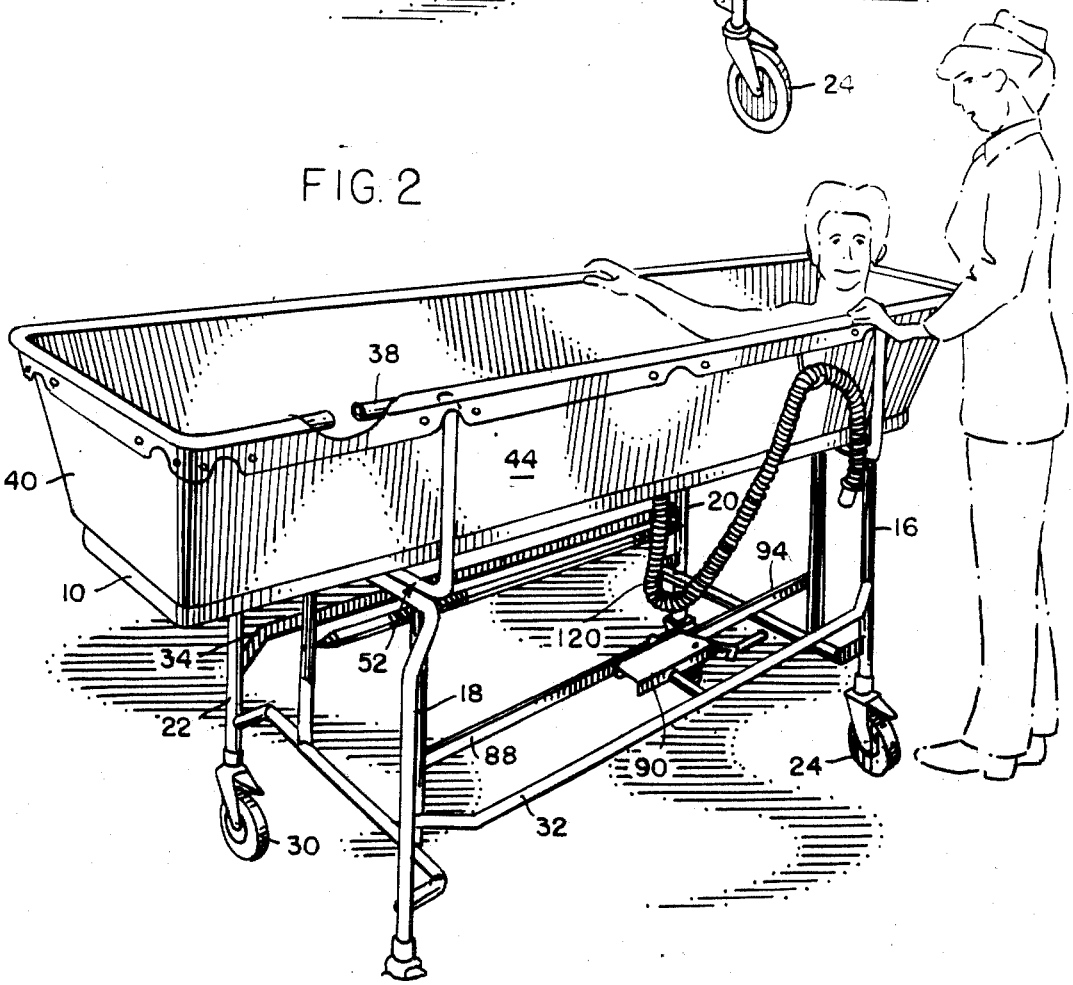
FIG. 2 is a perspective view of the improved apparatus of the invention with the tub enclosure in the extended or tub forming position.
Figure 3:
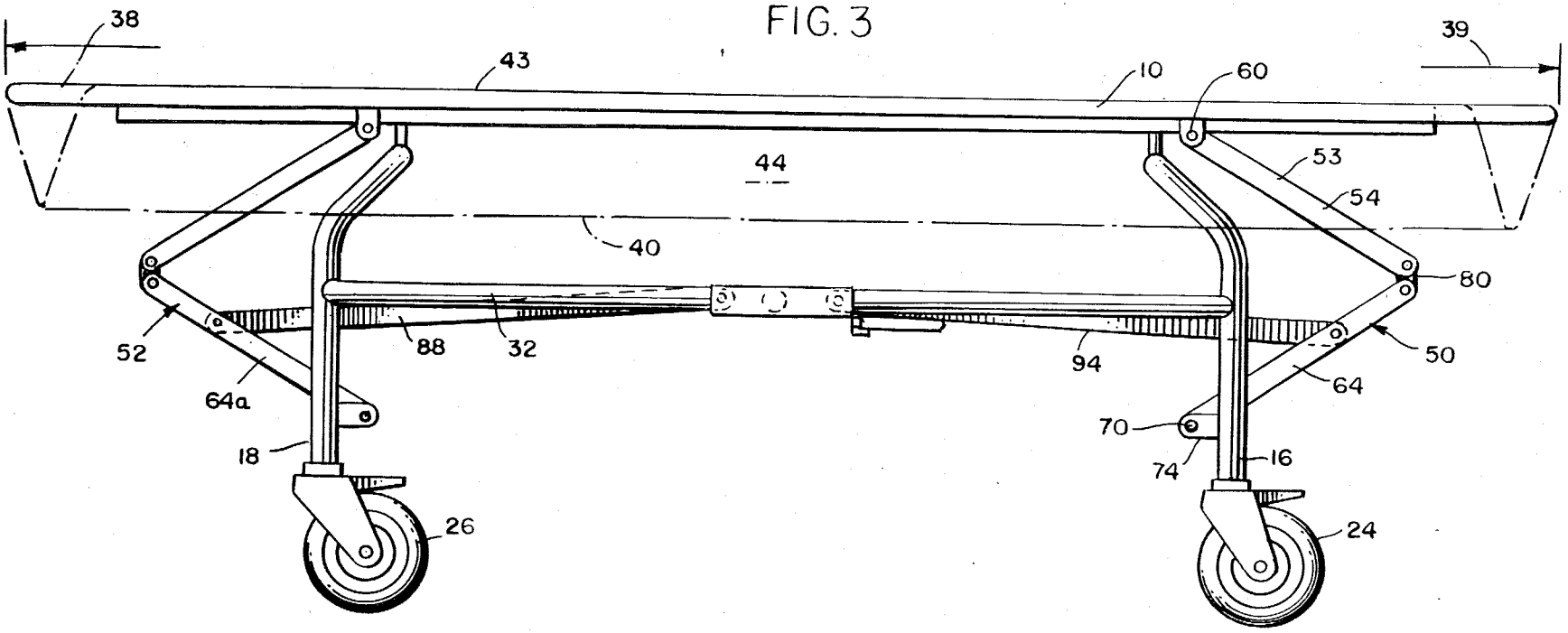
FIG. 3 is a side elevation of the tub enclosure in the lowered condition.
Figure 4:
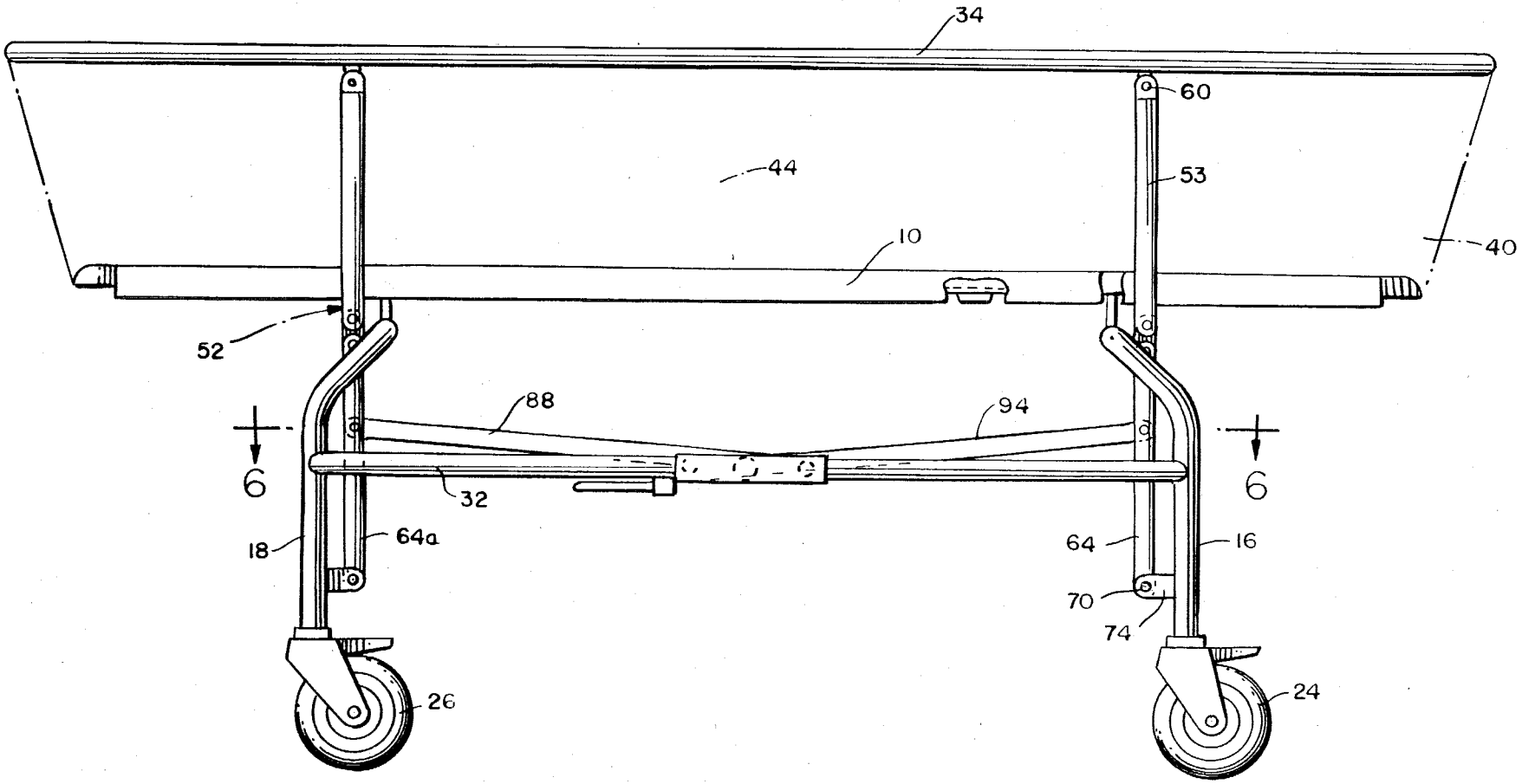
FIG. 4 is a side elevation of the tub enclosure in the extended or formed position.
Figure 5:
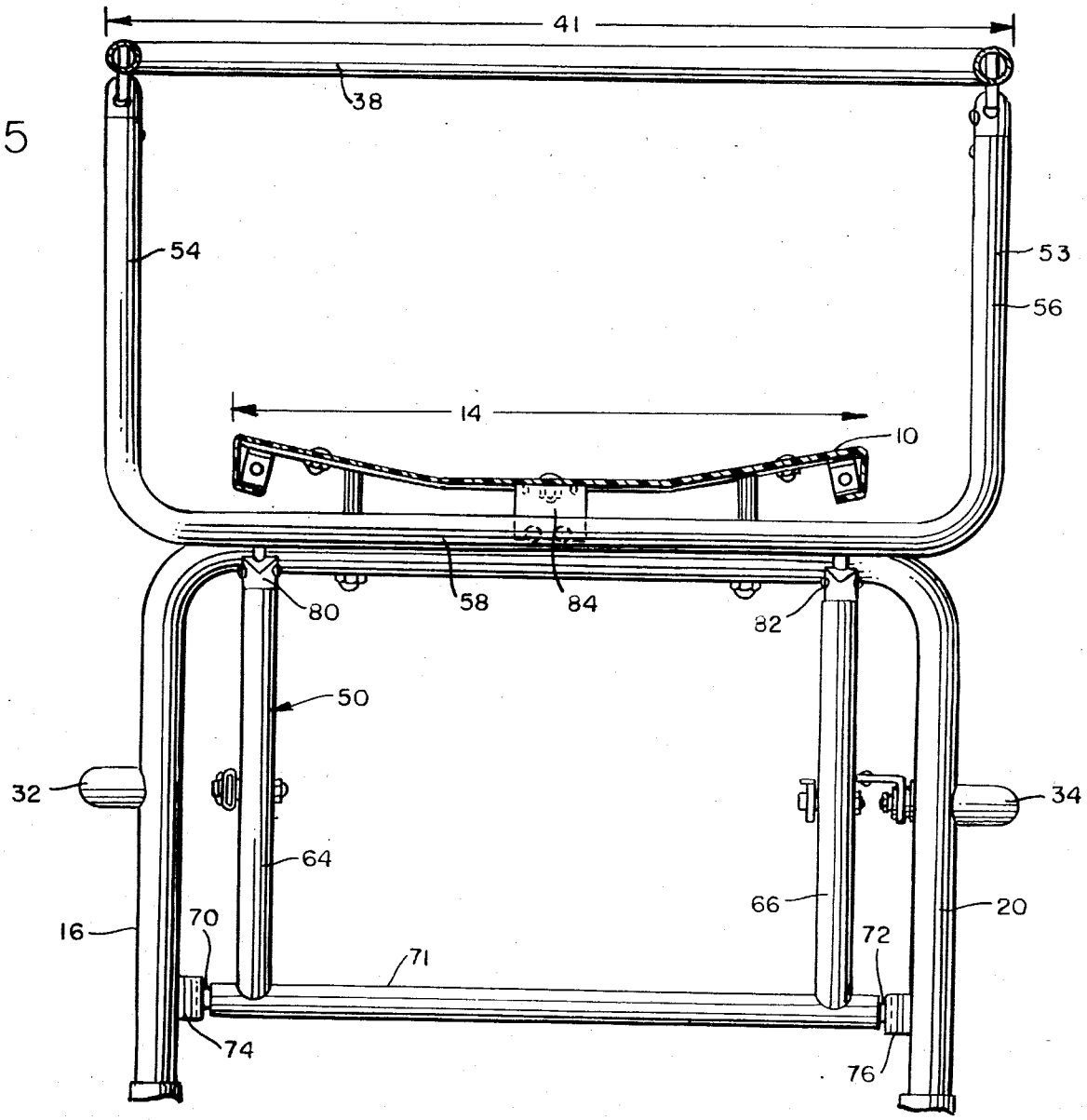
FIG. 5 is an end plan view of the apparatus in the extended tub enclosure position.

A circumferential frame 38 having a lateral dimension 39 slightly greater than the lateral dimension 14 of the tray 10 and a longitudinal dimension 41 also slightly greater than the longitudinal dimension 12 of the tray is supported by an articulated arm assembly (to be described) for movement between the position above the platform 10 as shown in FIG. 3 to a position substantially even with the platform 10 as shown in FIG. 4. The frame 38 cooperates with a flexible, waterproof liner 40. The liner 40 has a bottom section 43 which is supported by the tray 10. Extending from bottom section 43 are sides 44 which define a tub enclosure when the frame 38 is in the extended or up position as illustrated in FIG. 3. The liner 40 may be removably attached by any number of means onto the frame 38, for example by snap fittings or some other fastener which holds the top of the liner 40 onto the frame 38.

The frame 38 is supported by articulated arm assemblies comprised of articulated arm assemblies 50 and 52. Each of the arm assemblies 50 and 52 are substantially identical in construction, however, they are arranged to pivot in opposite directions. Arm assemblies 50 and 52 attach the cart legs 16, 18, 20, 22 to the frame 38. Thus, referring to the figures, the arm assembly 50 includes an upper arm member 53 in the form of a U-shaped bracket having vertical arm members 54, 56 connected by a crown member 58. The arm members 54, 56 are pivotally connected to opposite sides of the frame 38 and are interconnected by the crown 58 which passes beneath the platform or tray 10. The arm members 54, 56 are pivotally attached at pivot connections 60, 62.

Arm assembly 50 also includes lower articulated arm members 64, 66 attached respectively to the legs 16 and 20 by means of a cross bar 71 having opposite end pivot connections 70, 72 associated with a bracket 74, 76 fixed to the legs 16 and 20, respectively. The lower arms 64, 66 connect to a pivot connection 80, 82, respectively, associated with the crown 58 of the upper arm assembly. The brackets 74, 76 are arranged so that the lower arms 64, 66 are positioned on the inside of the legs 16 and 20 thereby permitting the articulated arm assembly 50 to move between the positions shown in FIG. 3 and FIG. 4 by bending along the pivot connections, 80, 82. A bumper or bracket member 84 projecting from the bottom of the platform 10 limits the pivoting action of the arm assembly 50 as the arm assembly 50 pivots toward the fully extended position.

The second arm assembly 52 constitutes a mirror image of the arm assembly 50 both in construction and operation. The separate parts of the assembly 52 are labeled with a subscript "a". Thus, the lower arms 64, **64*a* of the assemblies 50, 52 are interconnected by a linkage arrangement. Specifically, a first link 88 pivotally connects to lower arm 64*a* at one end and at the opposite end to intermediate linkage plate 90 at a pivot connection 92. A second link 94 pivotally connects from lower arm 64 through a pivot connection to a second pivot 96 associated with the intermediate plate 90. The intermediate plate 90 is mounted on a pivot member 98 projecting laterally from the bracket 32**.

The intermediate link or plate 90 is rotatable about the pivot axis of pivot member 98 to shorten the total length of the linkage comprising the first link 88, linkage plate 90 and second link 94 by a distance equal to two times the length of plate 90, i.e. two times the distance between first pivot connection 92 and second pivot connection 96. Rotational movement of plate 90 thus effects movement of the arm assemblies 50, 52 between the articulated and unarticulated positions.

Figure 6:
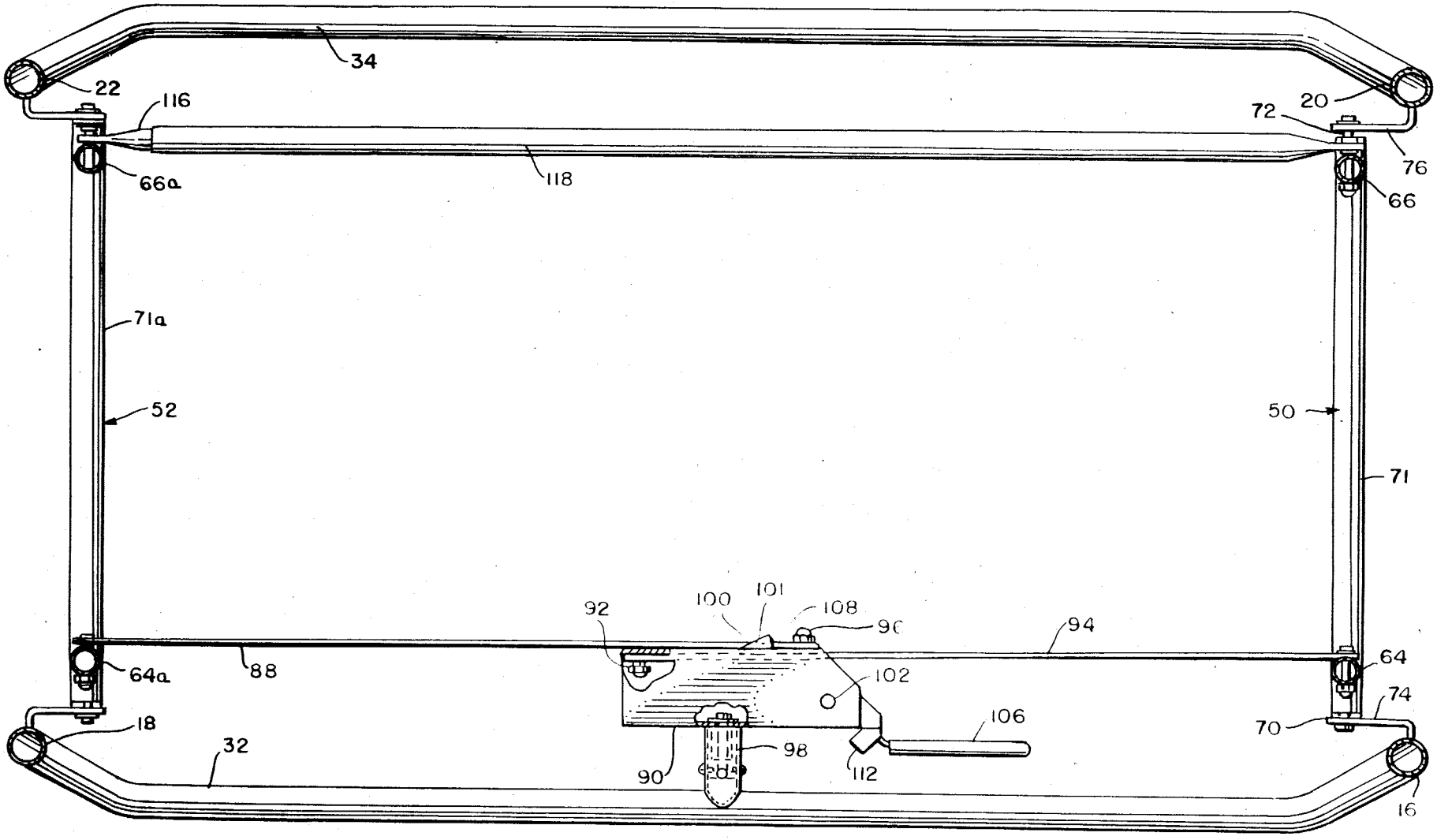
FIG. 6 is a plan cross-sectional view taken along the line 6—6 in FIG. 4.

FIG. 6 depicts the arrangement of the links 88 and 94 and plate 90 with the linkage in the shortened condition which is equivalent to the raised condition for frame 38 associated with the articulated arms 50, 52. That is, the intermediate plate or link 90 has been pivoted about the pivot connection 98 so that the effective length of the link arms 88 and 94 is at its minimum. When in this position, the intermediate plate 90 is held in position bby a locking bar or plate 100 that cooperates with link 88 to prevent further rotation of the plate 90 and thus locks the linkage in the condition depicted. Pivoting of the locking plate 100 about its pivot point 102 will permit release of the link 88 from cooperation with the plate 100 and thus permits effective rotation of plate 90 and the link arms 88 and 94 thereby permitting lowering of the articulated arms and associated frame 38.

More specifically, referring to the remaining figures, the plate 90 has a generally U-shaped cross section defined by planar member 95 and flanges 91 and 93. Flange 91 has associated therewith pivot connection 96 for the link 94 at one end and a pivot connection 92 for the link arm 88 at the opposite end. The link 94 is positioned on the inside of the U-shaped bracket or plate 90 between the flanges 91, 93. The link 88 is positioned on the outside of flange 91 so that it will not interfere with the link 94. The opposite flange 93 is attached to the pivot member 98. A handle 106 extending from the U-shaped plate 90 is provided to permit manual movement of the plate 90 about the pivot member 98 thus effectively operating the links 88 and 94.

A slot 108 extends through the flange 91 adjacent planar member 95. Plate 100 is pivotally attached to the plate 90 and includes a tab or tang 101 which fits through the slot 108. Tab 101 is biased through the slot 108 by action of a spring 110. A thumb actuated lever or member 112 associated with the plate 100 may be manually manipulated to pivot plate 100 about its pivot point against the force of spring 110 to disengage the tab 101 from the slot 108.

The opposite side lower legs 66, **66*a* are interconnected by a tension spring 114 enclosed in telescoping tubes 116, 118 as depicted in FIG. 9. In the embodiment, a spiral tension spring interconnects with pivot connections associated with the lower arms 66, 66*a*. The telescoped tubes 116, 118 interconnect with the spring pivot connections also. The spring 114 is sized to provide sufficient tension to draw the arms 66, 66*a* together and help promote movement of the frame 38** from the lowered to raised position.

In operation, the tab 101 associated with the plate 90 is released by operation of the thumb latch member 112. The handle 106 is then actuated to pivot plate 90 which, in turn, actuates the links 88, 94. This causes the articulated arm assemblies 50, 52 to move between the extended and retracted position. When in the extended position, of course, the latch plate tab 101 locks against the top side of the link 88. The plate 95 of bracket 90 engages the second link 94 thus preventing any unwanted movement or pivoting action of the articulated arms. A drain connection is preferably provided in the bottom of the liner 40 having a hose 120 associated therewith.

In practice, the frame 38 is lowered so that the sides 44 of the liner 40 are lowered. A patient may then be placed on the platform or tray 10. The frame 38 may be raised by extending the articulated arm assemblies 50, 52 to their projected position. Subsequently the liner 40 may be filled with water and the patient bathed. Of course, the patient may be transported from one place to another inasmuch as the cart is on wheels. The patient need not be transported along with the entire contents of the tub enclosure or liner 40, however, since the formed liner 40 may be drained.

While there has been set forth a preferred embodiment of the invention, it is to be understood that the invention is to be limited only by the following claims and their equivalents.

What is claimed is:

1. In a portable bathing apparatus of the type including a rigid, generally horizontal support platform having a longitudinal and a lateral dimension;

support legs attached to the platform for supporting the platform above a floor;

a flexible, tub shaped, open top enclosure, having a bottom section and side sections to form the enclosure;

a generally circumferential frame for supporting the side sections of the enclosure as the bottom section is supported on the platform, said frame also having a longitudinal and a lateral dimension substantially coextensive with the corresponding platform dimensions;

the improvement comprising a frame support assembly for raising and lowering the frame and attached side sections between a raised tub enclosure configuration and a lowered collapsed position, said frame support assembly including a plurality of articulated lifting arm assemblies, each of said arm assemblies defining an intermediate pivot connection, and opposite end pivot connections, one end pivot connection of each arm assembly being attached to a leg, the opposite end pivot connection of each arm assembly being connected to the frame, each arm assembly being extensible between an unarticulated, straight position to raise the side sections and an articulated position to lower the side sections; said arm assemblies being arranged in cooperating pairs to move in unison, and transport the frame support assembly substantially vertically, at least one adjacent pair of arm assemblies being articulated to bend in opposite directions and connected by links operable to simultaneously extend the arm assemblies between the straight and articulated positions;

said arm assemblies each comprising a lower arm member and an upper arm member on the same longitudinal dimension side of the platform, and the links comprising a link from each lower arm member connected respectively with the opposite sides of an intermediate link, said intermediate link being rotatable about a point to shorten the total linkage legnth by two times the connective distance of the intermediate link, to thereby move the arm assemblies from the articulated to the straight position.

2. The improvement of claim 1 including means on the intermediate link for locking the links to maintain the arm assemblies in the straight position.

3. The improvement of claim 2 wherein the means for locking comprises a latch bar mounted on the intermediate link for movement transversely with respect to the links, and biasing means for biasing the latch bar into engagement with a link to limit movement of the link.

4. The improvement of claim 1 including a generally horizontal brace connecting the legs on one side of the platform and wherein the intermediate link is pivotally attached to the brace.

5. The improvement of claim 1 including a handle member attached to the intermediate link for pivoting the intermediate link by manual actuation.

6. The improvement of claim 1 wherein the arm assemblies comprise a lower arm member pivotally attached to the cart at one end and an upper arm member pivotally attached to the frame at one end and to the lower arm member at its other end, one pair of said arms being positioned along one longitudinal edge of the frame to support the frame, said pair of arms being articulated in opposite directions and having their lower arm members connected by a first link extending from one lower arm member and pivotally attached to an intermediate link, and a second link extending from the other lower arm member and pivotally attached to the same intermediate link, said intermediate link being rotatable generally in a plane defined by the links to vary the length of the linkage and thereby extend or retract the arms to raise or lower the frame.

7. The improvement of claim 6 wherein the intermediate link has at least a generally vertical flange connected on one side to the first link and on the opposite side to the second link, said intermediate link also including a horizontal flange portion extending from the vertical flange and defining a stop to limit pivotal movement of the intermediate link relative to the first link, and also including a locking bar cooperative with the second link to maintain the links and attached arms in a locked position.

8. The improvement of claim 7 wherein the locking bar comprises a locking plate pivotally mounted on the horizontal flange and projecting through a slot in the vertical flange of the intermediate link to engage the second link, and biasing means for the locking plate to bias the plate into position to engage the second link.

9. The improvement of claim 8 including a manual actuation member for releasing the locking bar against the second link to permit pivotal movement of the intermediate link.

10. The improvement of claim 1 including a tension connection between two articulated arm assemblies for biasing the arm assemblies toward the straight position.

11. The improvement of claim 10 wherein the tension connection comprises telescoped tubes, each tube having one end pivotally attached to an arm asembly, said tubes including an enclosed tension spring member connected at its opposite ends to an arm assembly.

* * * * *